United States Patent [19]

Hunter et al.

[11] 4,080,150

[45] Mar. 21, 1978

[54] CATALYTIC GAS IGNITER SYSTEM

[75] Inventors: James B. Hunter, Newtown Square; Larry L. Lawlor, Glenmoore; George McGuire, West Chester, all of Pa.

[73] Assignee: Matthey Bishop, Inc., Malvern, Pa.

[21] Appl. No.: 736,205

[22] Filed: Oct. 27, 1976

[51] Int. Cl.[2] ..... F23Q 11/04

[52] U.S. Cl. ..... 431/6; 431/268

[58] Field of Search ..... 431/2, 42, 6, 278, 268, 431/283, 354, 356

[56] References Cited

U.S. PATENT DOCUMENTS 3,909,187 9/1975 Gregory ..... 431/268

4,021,183 5/1977 Gillis et al. ..... 431/2

*Primary Examiner*—Edward G. Favors

*Attorney, Agent, or Firm*—Cushman, Darby & Cushman

[57] ABSTRACT

A method and apparatus for the ignition of a hydrocarbon gas stream utilizing a hydrogen pre-ignition arrangement. A small volume of hydrogen gas is mixed with air and directed past a platinum containing catalyst, e.g., activated with aluminum and in mesh form to heat the catalyst. A flame is produced and extends away from the catalyst and is directed from the catalyst so that it intersects a hydrocarbon gas stream and ignites the hydrocarbon gas stream at room temperature.

27 Claims, 7 Drawing Figures

Fig. 1
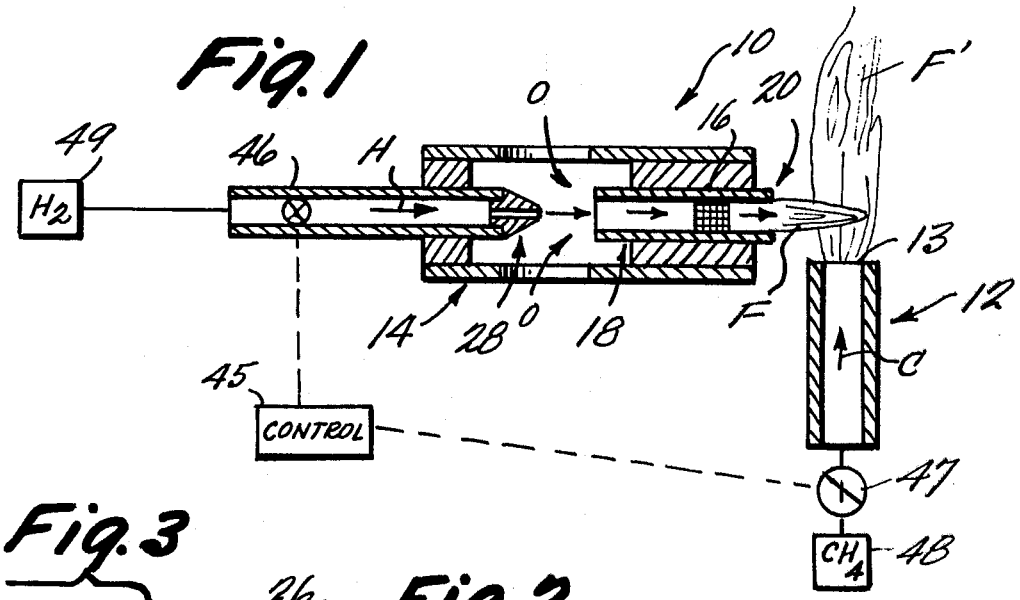
Fig. 3
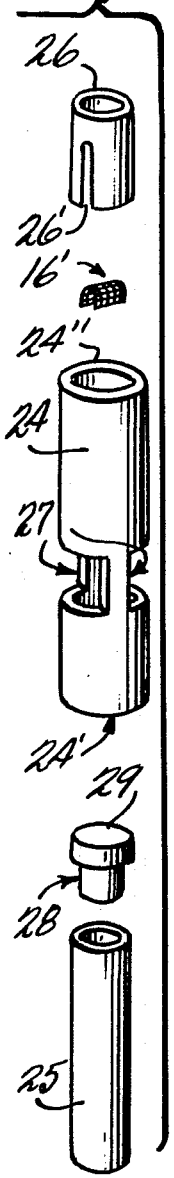
Fig. 2
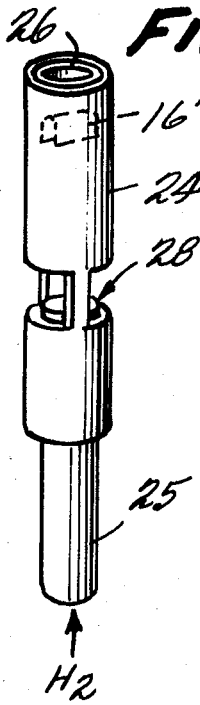
Fig. 4
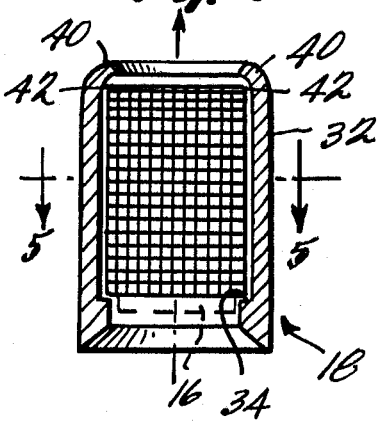
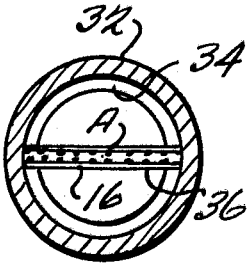
Fig. 5
Fig. 6a
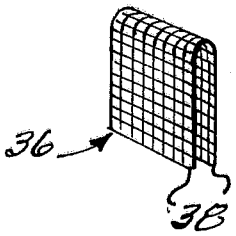
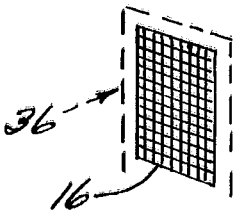
Fig. 6b

CATALYTIC GAS IGNITER SYSTEM

BACKGROUND AND SUMMARY OF THE INVENTION

The invention relates to a method and apparatus for the ignition of a hydrocarbon gas stream utilizing a hydrogen pre-ignition arrangement. While the utilization of hydrogen acting on a catalyst to heat the catalyst which in turn heats hydrocarbon gas stream has per se been known in the art (i.e., see U.S. Pat. Nos. 3,518,036 and 3,909,187), previously there has not been a method or apparatus utilizing hydrogen pre-ignition that did not require contact of the catalyst with the hydrocarbon gas stream, and/or utilized hydrogen at low pressure and room temperature (the normal temperature in the surroundings of a conventional gas stove), and/or utilized ambient air for mixture with the hydrogen.

According to one aspect of the present invention, a flame is produced (flame as used herein means a flash and detonation or the like) by the passage of a mix of hydrogen and oxygen-containing gas into contact with the past a Rh/Pt catalyst activated with Al, preferably in gauze configuration. The flame is then directed so that it intersects a hydrocarbon gas stream, igniting the hydrocarbon gas stream. In this way, the catalyst always remains out of the heat of the gas stream and the life of the catalyst is thereby greatly extended. Also, because the particular catalyst, according to the present invention, for use in igniting a hydrocarbon gas stream is used, the hydrogen-air mix may be at room temperature, and need not be heated, resulting in greatly simplified equipment. Since only a small-volume high-velocity stream of hydrogen gas is used for each ignition, the life of the catalyst is even further extended, as is the life of the hydrogen supply whether it be a container with a hydrogen sponge and hydrogen gas at low pressure (i.e., 10 psi), or other suitable conventional structure. The method and apparatus according to the present invention have the advantages of extended catalyst life, extended hydrogen source life, simplicity of components and safety over prior art structures, these advantages making the method and apparatus according to the present invention imminently suited for use with a conventional gas stove in a residential or commercial facility in place of an electric igniter or a pilot light. Since no electrical components need be provided, the invention has still further advantages of simplicity over representative prior art arrangements.

According to one aspect of the present invention, a method of igniting a hydrocarbon gas stream is provided comprising the steps of establishing a flow of hydrogen gas into contact with a 10% Rh/Pt alloy catalyst activated with aluminum and in mesh form to heat the catalyst and establishing a flow of hydrocarbon gas in the vicinity of the catalyst to ignite the hydrocarbon gas with the heated catalyst. The hydrogen gas preferably is at room temperature and a small-volume, intermittent, high-velocity flow from a low-pressure source. According to another aspect of the present invention, a method of igniting the hydrocarbon gas stream utilizing a conduit confining a hydrocarbon gas stream and a hydrogen catalyst at all times disposed out of the hydrogen gas stream, is provided comprising the steps of establishing a flow of hydrogen gas and mixing the hydrogen gas flow with oxygen-containing gas (i.e., ambient air), directing the hydrogen-air gas flow past and in contact with a catalyst to produce a flame extending away from the catalyst, establishing a flow of hydrogen gas through and from the conduit and directing the flame from the catalyst so that it intersects the hydrogen gas stream and ignites the hydrocarbon gas stream.

According to another aspect of the present invention, apparatus for igniting a hydrocarbon gas stream is provided comprising a conduit confining a hydrocarbon gas stream and having a terminal opening through which the gas stream flows, means for establishing a flow of hydrogen gas and mixing the hydrogen gas flow with air, a hydrogen catalyst mounted out of the hydrogen gas stream at all times, means for directing the hydrogen-air gas flow past and in contact with the catalyst to produce a flame extending away from the catalyst and means for directing the flame from the catalyst so that it intersects the hydrocarbon gas stream from the conduit and ignites the hydrocarbon gas stream. The hydrogen handling component, according to the present invention, includes a tubular body member having first and second ends, a tubular inlet extending into the body member first end and received by the body member and terminating within the body member, a gauze configuration catalyst, means for supporting the catalyst within the body member spaced from the termination of the inlet and spaced from the second end of the body member and means defining an opening in the body member between the termination of the inlet tube and the catalyst supporting means. The catalyst preferably comprises a 10% Rh/Pt alloy activated with aluminum in an 80 mesh gauze configuration with 0.003 inch diameter wire forming the gauze. The gauze is preferably planar and is disposed within the supporting means therefor so that the axis of the tubular body member does not intersect the plane of the gauze.

According to yet another aspect of the present invention, an apparatus is provided as a subcomponent for use in hydrocarbon gas ignition assembly, the subcomponent comprising a tube portion having an axis and having an interior shoulder formed therein, a substantially planar catalyst gauze disposed in the tube portion so that the plane of the gauze does not intersect the axis, a generally U-shaped non-catalyst metal mesh sandwiched around the catalyst gauze, portions of the mesh abutting the interior shoulder and deformed end portions of the tube portions spaced from the interior shoulder along the axis and engaging portions of the metal mesh.

It is the primary object of the present invention to provide a hydrocarbon gas stream igniting method and apparatus with increased simplicity, extended catalyst life and a minimum number of electrical components. This and other objects of the invention will become clear from an inspection of the detailed description of the invention and from the appended claims.

BRIEF DESCRIPTION OF THE DRAWINGS

FIG. 1 is a diagrammatic side cross-sectional view of exemplary apparatus, according to the present invention, for practicing the method according to the invention;

FIG. 2 is a perspective view of a portion of the apparatus of FIG. 1;

FIG. 3 is an exploded view of the apparatus of FIG. 2;

FIG. 4 is a side view, partly in cross-section, of an exemplary catalyst and catalyst mounting structure according to the invention;

FIG. 5 is a cross-sectional view of the apparatus of FIG. 4 taken along lines 5—5 thereof;

FIG. 6*a* is a perspective view of an exemplary U-shaped non-catalyst metal sandwiching member; and FIG. 6*b* is a perspective view of an exemplary catalyst gauze, according to the present invention, the member of FIG. 6*a* shown in dotted line in cooperation therewith.

DETAILED DESCRIPTION OF THE INVENTION

According to the present invention, a method for igniting a hydrocarbon gas stream (i.e., $CH_4$, $C_3H_8$) by establishing a flow of hydrogen gas into contact with a catalyst that will ignite hydrogen at room temperature — such as a 10% Rh/Pt alloy catalyst activated with Al and in mesh form — to heat the catalyst and establishing a flow of hydrocarbon gas in the vicinity of the catalyst to ignite the hydrocarbon gas with the heated catalyst. According to another aspect of the present invention, a method is provided for igniting a hydrocarbon gas stream utilizing a conduit confining a hydrocarbon gas stream and hydrogen catalyst at all times disposed out of the hydrogen gas stream, the method comprising the steps of establishing a flow of hydrogen gas and mixing the hydrogen gas flow with oxygen-containing gas, directing the oxygen-containing gas, hydrogen mixture past and in contact with a catalyst to produce a flame extending away from the catalyst, establishing a flow of hydrocarbon gas through and from the conduit and directing the flame from the catalyst so that it intersects the hydrocarbon gas stream and ignites the hydrocarbon gas stream. Exemplary apparatus, according to the present invention, for practicing the methods of the present invention is shown generally at 10 in FIG. 1. The apparatus generally includes a conduit 12 confining a hydrocarbon gas stream and having a terminal opening 13 through which the gas stream C flows, means 14 for establishing a flow of hydrogen gas H and mixing the hydrogen gas flow with oxygen-containing gas O (such as air), a hydrogen catalyst 16 mounted out of the hydrocarbon gas stream C at all times, means 18 for directing the hydrogen-oxygen-containing gas flow past and in contact with the catalyst 16 to produce a flame F extending away from the catalyst 16 and means 20 for directing the flame F from the catalyst 16 so that it intersects the hydrocarbon gas stream C from the conduit and ignites the hydrocarbon gas stream (at F').

As shown most clearly in FIGS. 1, 2 and 3, the portion of the apparatus that deals with the hydrogen gas and the oxygen-containing gas includes a tubular body member 24 having first and second ends, 24' and 24'' thereof, a tubular inlet 25 extending into the body member 24 first end 24' and received by the body member 24 and terminating within the body member, a gauze configuration catalyst 16 (or 16'), means 26 for supporting the catalyst 16' within the body member spaced from the termination of the inlet 25 and spaced from the second end 24'' of the body member 24 and means 27 defining an opening in the body member between the termination of the inlet tube 25 and the catalyst supporting means 26. The gauze configuration catalyst 16' may be U-shaped and mounted in slot 26' of the catalyst supporting means 26. Means 28 may be provided for increasing the velocity of hydrogen gas H flowing through the tubular inlet 25 at the termination thereof, the means 28 including a nozzle having a pinhole orifice 29 therein generally concentric with the inlet tube 25. The means 14 for establishing a flow of hydrogen gas and mixing the hydrogen gas flow with the oxygen-containing gas includes the inlet 25, the nozzle 28, the first end 24' of the body member and the opening 27. The means 18 for directing the hydrogen-oxygen-containing gas flow past the catalyst 16 to produce a flame extending away from the catalyst includes interior middle portions of the body member 24 and the catalyst mounting means 26, and the means 20 for directing the flame F from the catalyst 16 so that it intersects the hydrogen gas stream C includes the end portion of the mounting means 26 as well as the second end 24'' of the body member.

The catalyst 16 may have a planar gauze form as shown most clearly in FIG. 6*b*. Since it is preferred to ignite hydrogen at room temperature, according to the present invention, the catalyst 16 preferably is a platinum metal or alloy thereof supported on an active substrate support which will cause the hydrogen gas to ignite at room temperature. For example, an aluminum-activated platinum-group metal containing catalyst, or a platinum-group metal or alloy thereof, supported on an appropriate ceramic support or the like resulting in the ignition of the $H_2$ at room temperature may be utilized. One such catalyst is a 10% Rh/Pt alloy activated with aluminum. An aluminum coating is first applied to the Rh/Pt gauze and the gauze heated for a given time at elevated temperature to cause aluminum diffusion into the Rh/Pt surface. Perferably, the gauze is 80 mesh, and exemplary dimensions are three-sixteenths by five-sixteenths. Such Rh/Pt gauze activated with aluminum is commercially available from Alloy Surfaces Company, Wilmington, Del. While other catalysts may be used, if other catalysts are used, the hydrogen must generally be heated above room temperature before ignition thereof occurs. ("Room temperature" as used herein means generally the ambient temperature in a home or like facility having a conventional gas stove or the like.)

Preferably, the catalyst gauze 16, when in planar form as shown in FIG. 6*b*, is mounted in a tube portion 32 as shown in FIG. 4. The tube portion 32 may be utilized in place of the means 26 shown in FIG. 3, or otherwise utilized in structure for accomplishing the present invention. The tube portion 32 has an axis A—A and an interior shoulder 34 formed therein. A generally U-shaped non-catalyst metal mesh 36 is sandwiched around the catalyst 16 (see FIG. 6*b* in particular), and portion 38 of the mesh 36 abuts the interior shoulder 34 of the tube 32 to mount the mesh 36 and catalyst 16. Preferably, the mesh 36 is made of Kanthal (30 mesh). Deformed end portions 40 of the tube portion 32 engage upper portions 42 of the mesh 36 to assist in holding the gauze/mesh sandwich within the tube portion 32 so that the plane of the gauze 16 does not intersect the axis A—A. The deformed portions 40 of the tube portion 32 (which may be stainless steel tubing three-eighths long) are formed by the utilization of a tubing cutter which forms bends in the tube.

Referring again to FIG. 1, in operation of the apparatus 10, according to the present invention, a control 45 is operated by the user which opens valves 46 and 47. Preferably, valve 46 is a momentary snap action type valve that releases only a very small volume of hydrogen from a hydrogen source 49 or the like, just enough hydrogen so that when its velocity is increased through the nozzle 28 and it is mixed with air or other oxygen-containing gas and passed by the catalyst 16, a flame F of sufficient magnitude will be produced to ignite the hydrocarbon gas stream C which it intersects. The hydrogen source 49 may be any suitable conventional structure, such as a hydrogen sponge material in a container at about 10 lbs/sq. inch pressure. Exemplary hydrogen sponges that can be used are iron titanium compositions and nickel lanthanide. It is desired that the hydrogen source be at low pressure for safety reasons and to minimize the amount passed by valve 46 each time the control 45 is operated. The valve 47 is also operated by the control 45 and connects a source of natural gas 48 (such as a city line) with the conduit 12. It is generally desired that the valve 47 remain open until the control 45 is closed, however, it is possible to use the valve 47 and the conduit 12 as a secondary igniter for yet another primary natural gas stream. The synchronization of the valves 46 and 47 is provided by the common control 45.

The small flow of hydrogen gas H from the source 49 passes through the valve 46, through the orifice 29 whereat the velocity thereof is significantly increased and it mixes with oxygen-containing gas O before being directed to the catalyst 16. Preferably, the oxygen-containing gas O is ambient air. The combination of low pressure, room temperature hydrogen and ambient air as the source materials for the ignition flame makes the structure and method, according to the present invention, universally practical. The oxygen-containing gas O flows freely through the two cut-out portions 27 of the body member 24 disposed on either side of the nozzle 28 to provide complete mixing of the hydrogen with oxygen, the mixing taking place just before catalyst 16 is contacted by the gas mixture stream. Preferably, the flow through the directing means 18 past the catalyst 16 is parallel to the plane of the gauze 16. By mounting the catalyst 16 within the body 24 or the like and utilizing the gas flame to ignite the hydrocarbon gas stream instead of the catalyst itself, the life of the catalyst can be greatly extended. Also, the mesh 36 provides some protection for the catalyst, and the fact that only small intermittent volumes of hydrogen are used also extends the life of the catalyst 16.

It will be that, according to the present invention, a method and apparatus have been provided for facilitating the ignition of a hydrocarbon gas stream using a hydrogen preignition. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent methods and structures.

What is claimed is:

1. A method of igniting a hydrocarbon gas stream utilizing a conduit confining a hydrocarbon gas stream and a hydrogen catalyst at all times disposed out of the hydrocarbon gas stream, said method comprising the steps of (a) establishing a flow of hydrogen gas and mixing the hydrogen gas flow with oxygen-containing gas;
(b) directing said hydrogen-oxygen-containing gas flow past and in contact with the catalyst to produce a flame extending away from the catalyst;
(c) establishing a flow of hydrocarbon gas through and from the conduit; and
(d) directing the flame from the catalyst so that it intersects the hydrocarbon gas stream and ignites the hydrocarbon gas stream.

2. A method as recited in claim 1 wherein the hydrogen gas flow established is hydrogen gas at room temperature.

3. A method as recited in claim 2 wherein the hydrogen and oxygen-containing gas are mixed together immediately before contacting the catalyst.

4. A method as recited in claim 3 wherein the oxygen-containing gas is ambient air.

5. A method as recited in claim 1 wherein the flow of hydrogen gas established is a small-volume intermittent flow.

6. A method as recited in claim 1 wherein the catalyst is Rh/Pt alloy activated with Al.

7. A method as recited in claim 6 wherein the catalyst is about 10% Rh/90% Pt and wherein it is in the form of gauze.

8. A method as recited in claim 1 comprising the further step of increasing the velocity of the hydrogen gas flow just before mixing of the flow with oxygen-containing gas, and wherein the mixing is accomplished immediately before contacting of the catalyst with the hydrogen-oxygen-containing gas mix.

9. Apparatus for igniting a hydrocarbon gas stream comprising (a) a conduit confining a hydrocarbon gas stream and having a terminal opening through which the gas stream flows;
(b) means for establishing a flow of hydrogen gas and mixing the hydrogen gas flow with oxygen-containing gas;
(c) a hydrogen catalyst mounted out of said hydrocarbon gas stream at all times;
(d) means for directing said hydrogen-oxygen-containing gas flow past and in contact with the catalyst to produce a flame extending away from the catalyst; and
(e) means for directing the flame from the catalyst so that it intersects the hydrocarbon gas stream from the conduit and ignites the hydrocarbon gas stream.

10. Apparatus as recited in claim 9 wherein said catalyst is Rh/Pt alloy activated with Al.

11. Apparatus as recited in claim 10 wherein the catalyst is in the form of gauze.

12. Apparatus as recited in claim 11 wherein the gauze is substantially planar and wherein the means for directing the hydrogen-oxygen-containing gas flow directs the flow generally parallel to the plane of said catalyst gauze.

13. Apparatus as recited in claim 12 wherein said catalyst gauze is sandwiched by a non-catalyst metal mesh.

14. Apparatus as recited in claim 13 wherein the non-catalyst metal mesh is a generally U-shaped mesh of Kanthal.

15. Apparatus as recited in claim 13 further comprising a tube portion having an axis and having means associated with the interior thereof for supporting said catalyst gauze non-catalyst metal mesh sandwich so that the plane of the sandwich does not intersect the axis of the tube.

16. Apparatus as recited in claim 9 further comprising means for increasing the velocity of said hydrogen gas stream directly before mixing thereof with oxygen-containing gas.

17. Apparatus for igniting a hydrocarbon gas stream comprising (a) a tubular body member having first and second ends;

(b) a tubular inlet extending into said body member first end and received by said body member and terminating within said body member;

(c) a gauze configuration catalyst;

(d) means for supporting said catalyst within said body member spaced from the termination of said inlet and spaced from the second end of said body member; and (e) means defining an opening in said body member between the termination of said inlet tube and said catalyst supporting means.

18. Apparatus as recited in claim 17 further comprising means for increasing the velocity of hydrogen gas flowing through the tubular inlet at the termination thereof, said means including a nozzle having a pinhole orifice formed therein generally concentric with said inlet tube.

19. Apparatus as recited in claim 17 wherein said gauze catalyst is substantially planar and wherein said means for supporting said catalyst within said body member comprises a tube portion having an axis and having an interior shoulder for supporting said catalyst gauze thereon so that the plane of said gauze does not intersect said axis, said tube portion being disposed within said body member, having a smaller outside diameter than the inside diameter of said body member.

20. Apparatus as recited in claim 19 wherein said means for supporting said catalyst further comprises a non-catalyst metal mesh having a generally U-shape and sandwiched around said catalyst portions of said mesh abutting said interior shoulder of said tube portion.

21. Apparatus as recited in claim 20 wherein said means for supporting said catalyst further comprises deformed end portions of said tube portion spaced from said interior shoulder along said tube portion axis, said end portions engaging the U portion of said mesh and holding said mesh and catalyst within said tube portion.

22. Apparatus as recited in claim 18 wherein said means for defining an opening in said body member includes means defining two cut-out portions of said body member disposed on either side of said nozzle and extending from said nozzle toward said catalyst support means.

23. Apparatus for use in a hydrocarbon gas ignition assembly comprising (a) a tube portion having an axis and having an interior shoulder formed therein;

(b) a substantially planar catalyst gauze, disposed in said tube portion so that the plane of said gauze does not intersect said axis;

(c) a generally U-shaped non-catalyst metal mesh sandwiched around said catalyst gauze, portions of said mesh abutting said interior shoulder; and (d) deformed end portions of said tube portion spaced from said interior shoulder along said axis and engaging portions of said metal mesh.

24. A method of igniting a hydrogen gas stream comprising the steps of (a) establishing a flow of hydrogen gas substantially at room temperature into contact with a 10% Rh/Pt alloy catalyst activated with Al and in mesh form to heat said catalyst; and (b) establishing a flow of hydrocarbon gas in the vicinity of said catalyst to ignite said hydrocarbon gas with said heated catalyst.

25. A method as recited in claim 24 comprising the further steps of mixing the hydrogen gas with oxygen-containing gas before contact of the catalyst therewith, and at all times locating said catalyst outside said hydrocarbon gas stream, said heated metal catalyst igniting said hydrogen gas, which in turn ignites said hydrocarbon gas.

26. A method as recited in claim 25 comprising the further step of increasing the velocity of the hydrogen gas flow immediately prior to contact of the catalyst therewith.

27. A method as recited in claim 24 wherein said step of establishing a flow of hydrogen gas is accomplished by establishing a small-volume intermittent flow of hydrogen gas, from a low-pressure source.

* * * * *